US005123490A

United States Patent [19]

Jenne

[11] Patent Number: 5,123,490

[45] Date of Patent: Jun. 23, 1992

[54] SELF-CONTAINED SMOKE ACTIVATED FIRE EXTINGUISHING FLOODING SYSTEM

[75] Inventor: Keith D. Jenne, Dublin, Calif.

[73] Assignee: Charles E. Jennings, Walnut Creek, Calif.

[21] Appl. No.: 584,135

[22] Filed: Sep. 18, 1990

[51] Int. Cl.[5] ..... A62C 37/10; A62C 35/02

[52] U.S. Cl. ..... 169/61; 169/26; 169/51; 169/DIG. 3; 307/310; 340/590

[58] Field of Search ..... 169/26, 9, 37, 38, 41, 169/54, 58, 60, 61, 71, DIG. 3, 51; 340/590, 591; 307/310; 328/3, 6

[56] References Cited

U.S. PATENT DOCUMENTS 3,938,115 2/1976 Jacoby ..... 340/591 X 4,027,302 5/1977 Healey et al. ..... 169/61

4,664,197 5/1987 Leduc et al. ..... 169/26

4,771,270 9/1988 Kelso ..... 340/590

4,819,732 4/1989 Laumeister ..... 169/54 X 4,905,765 3/1990 Hein ..... 169/26 X

FOREIGN PATENT DOCUMENTS 3816917 11/1989 Fed. Rep. of Germany ..... 169/54

*Primary Examiner*—Margaret A. Focarino

*Assistant Examiner*—Andrew C. Pike

[57] ABSTRACT

A self contained smoke actuated fire extinguishing flooding system is comprised of: a dual battery powered source, a smoke detecting device, a spring load plunger actuated valve, audio alarm, and a built-in test system which utilizes a blended halogenated fire extinguishing agent that is intended for use in enclosures for electronic, electrical, and others.

1 Claim, 4 Drawing Sheets

SELF-CONTAINED SMOKE ACTIVATED FIRE EXTINGUISHING FLOODING SYSTEM

BACKGROUND

1. Field of Invention

This invention relates to a self-contained smoke activated fire extinguishing flooding system that has a dual power source consisting of a 9.0 volt battery and two 1.5 volt "D" cells batteries. More specifically, it relates to utilizing an ionization method of detecting a fire and extinguishing the fire by releasing a blend of halogenated gases into a desired enclosed area which is relying on a dual battery source for the internal power supply.

2. Description of Prior Art

A self-contained fire extinguishing flooding system, as described by Rosen in the U.S. Pat. No. 4,711,307, can be used with small electrical equipment that contains a knock-out aperture for installation of this system. The nozzle for the discharging of fire extinguishing agent is located in the interior of the electrical equipment being protected. This system is dependent on external temperature variations for activation hence a slow response time as oppose to detection by ionization. The system needs frequent inspections as it utilizes an inert gas as a expellant.

In U.S. Pat. No. 4,664,197, Leduc developed a self-contained system using a fusible linkage valve system connected to a container of fire extinguishing agent. The concern with this invention is that the extinguishing agent is of a dry chemical composition and the container is connected through conduit. For the system to be activated, the ambient temperature must be above a predetermined level. Hot air passing through a "combustible product flue" melts the fusible linkage activating the dry chemical release mechanism. This invention was developed for specific use in extinguishing fires in smoke stacks where there is a high volume of air movement. In other words, the fire must be in its blazing stage before the system is activated. The dry chemical composition leaves residues that would damage electrical systems while halogenated gases leave no residue.

Yasaki, in U.S. Pat. No. 4,609,048, develops an apparatus for automatically extinguishing fires. The fire sensor, the nozzle, and the container for the fire extinguishing agent and piping for connecting the valve shutoff to the other components are mounted inside a casing that rotates in the direction of the fire. The major concern with this unit is its economics, overall dimensions, and versatility. The activation of this unit is dependent on detecting a fire optically. Again, by the time the system is activated the fire is already in its blazing stage.

In U.S. Pat. No. 4,183,409, Iida developed an automatic fire extinguishing system that has incorporated an AC/DC power source to operate the system. The container for the single halogenated agent and expellant is actuated by an electrically operated valve which controls the discharge. Several major concerns with this patent are: 1) in the event that the electrical system controlling the valve malfunctions, this system does not have a failsafe backup system; and 2) there is a high maintenance need associated with this system.

Most of the self-contained fire extinguishing flooding systems utilizes a pressurized container that contains a single fire extinguishing gas composition with an inert gas composition as a expellent (i.e. a halogenated agent and/or nitrogen under pressure or a blend of several halogenated agents). These units are designed to provide protection at a predetermined location and cannot be easily relocated. These systems are activated by increasing the external temperature which melts a fusible link material that dislodges the valve stem on the pressurized container which releases the halogenated agent(s) into the desired area requiring protection. The effect of the halogenated agent(s) entering the desired area is to immediately extinguish the fire with minimum damage. To be effective, these systems must have a rapid response time in order to prevent the further destruction of the area desiring protection.

SUMMARY OF THE INVENTION

The main object of this invention is to provide a self-contained smoke activated fire extinguishing flooding system which eliminates the above described disadvantages of the prior arts, and to enable easy installation or removal of the system in or from a region wherein the self-contained smoke activated fire extinguishing flooding system would be most effective and allow flexibility in its various applications. There are several objects and advantages to inventing this unit and they are:

(a) The system provides a simple and effective fire extinguishing flooding system which uses a blended fire extinguishing gas composition to extinguish a fire when the smoke activated sensing device detects carbonaceous matter in a vapor state.

(b) The use of a blended fire extinguishing gas composition, (bromotrifluormethane and bromochlorodifluroro-methane), eliminates the need for a propellant gas (nitrogen or other inert gases), to provide the media necessary for discharging a single fire extinguishing gas.

(c) The seal and valve stem on the container for the fire extinguishing allows minimum leakage thereby providing the unit with a very long shelf life.

(d) The compactness of this system permit it to be used in a wide variety of applications without compromising its overall effectiveness.

(e) The construction of the activation mechanism provides the system with a fail-safe operation.

(f) The smoke activating mechanism allows for heightened sensitivity from smoldering combustions within the area of protection thereby allowing the system to extinguish a smoldering fire before it can spread and become destructive and expensive.

(g) The components and labor necessary to manufacture this system are economical and do not require a high skilled labor work force.

In addition, other objects and advantages of my invention will become apparent from a consideration of the drawings and ensuing description of it.

BRIEF DESCRIPTION OF THE DRAWINGS

The present invention will be clearly understood from the following detailed description read in conjunction with the accompanying drawings, in which.

REFERENCE NUMERALS IN DRAWINGS

Figure 1:
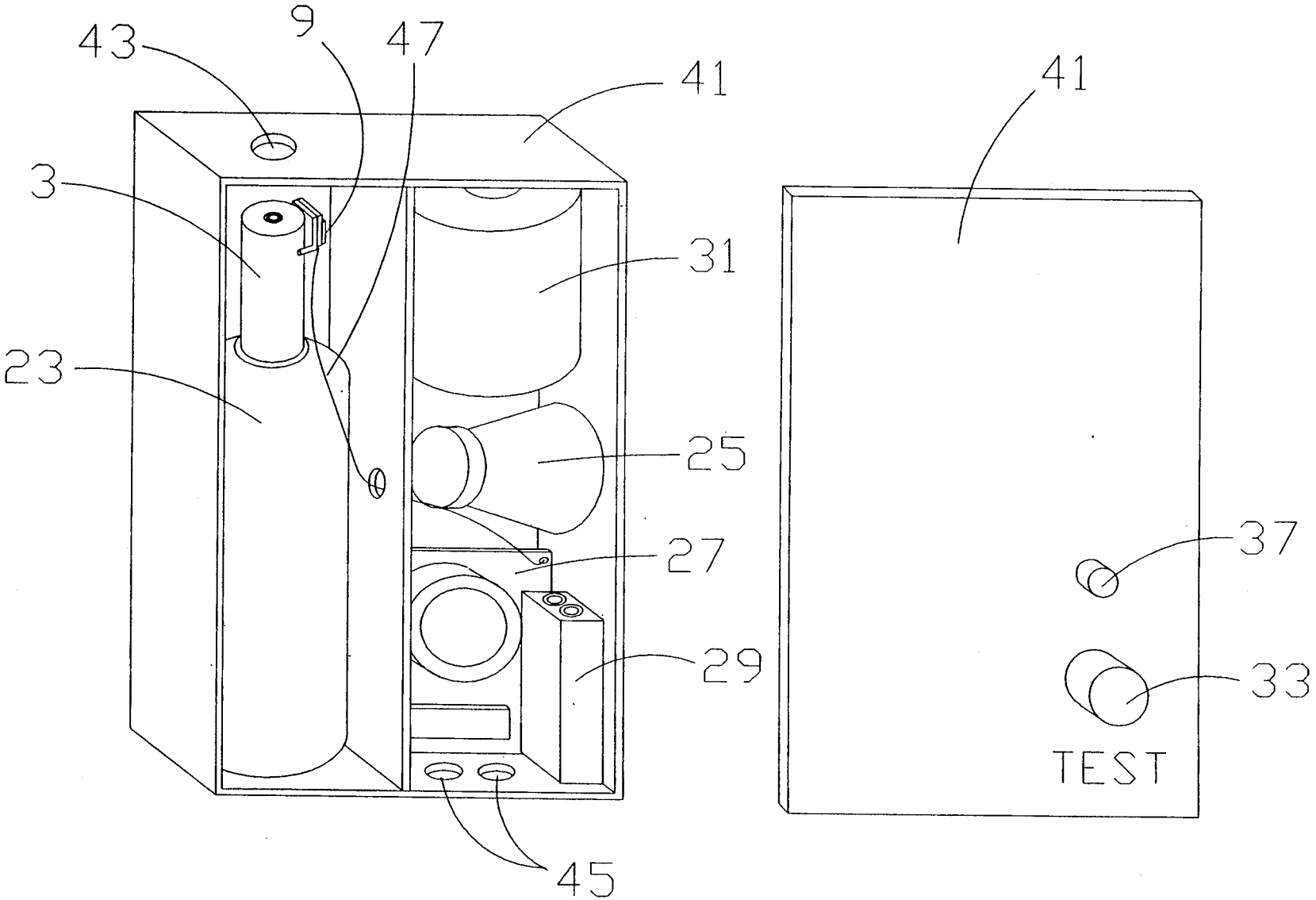
FIG. 1 depicts an overview of the self-contained smoke activated fire extinguishing flooding system.

| REFERENCE NUMERALS IN DRAWINGS | |
|---|---|
| 1 Valve Plunger | 3 Valve Housing |
| 5 Insulator | 7 6-32 screw |
| 9 Power Transistor | 11 Spring |
| 13 Fusible Link Material | 15 Ball Bearing |
| 19 Snap Ring | 21 Bottle Valve |
| 23 Halogenated Gas Bottle | 25 Audio Horn |
| 27 Smoke Detector | 29 9.0 volt Battery |
| 31 1.5 Volt "D" Cell Batteries | 33 Test Switch |
| 17 Collar | 37 LED |
| 39 1200 ohms, ½ watt resistor | 41 Enclosure |
| 43 Gas Release Port | 45 Vents |
| 47 Insulated wires | |

DETAILED DESCRIPTION OF THE PREFERRED EMBODIMENTS

Figure 3:
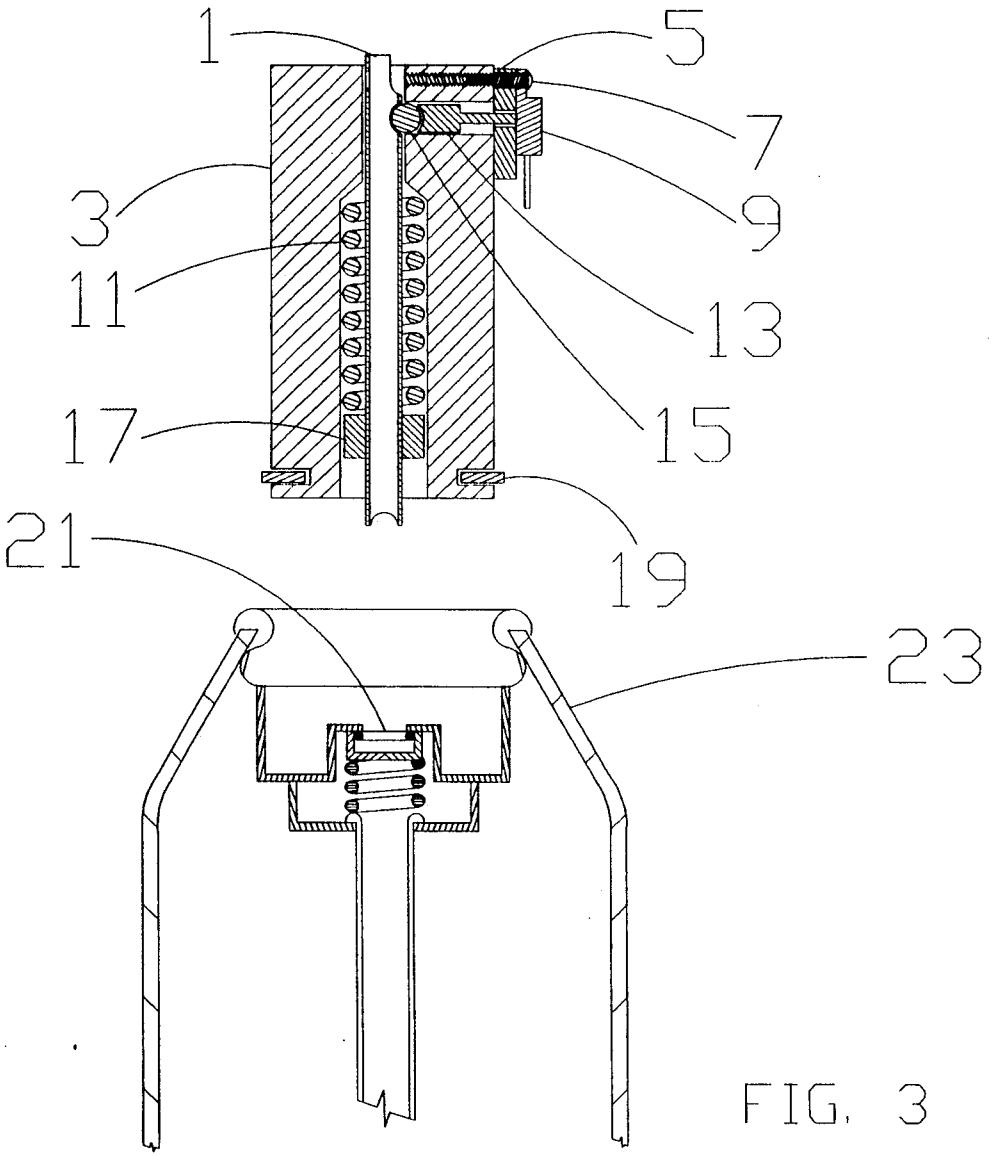
FIG. 3 depicts a cutaway view of the valve housing used to activate the self-contained smoke activated fire extinguishing flooding system.
Figure 4:
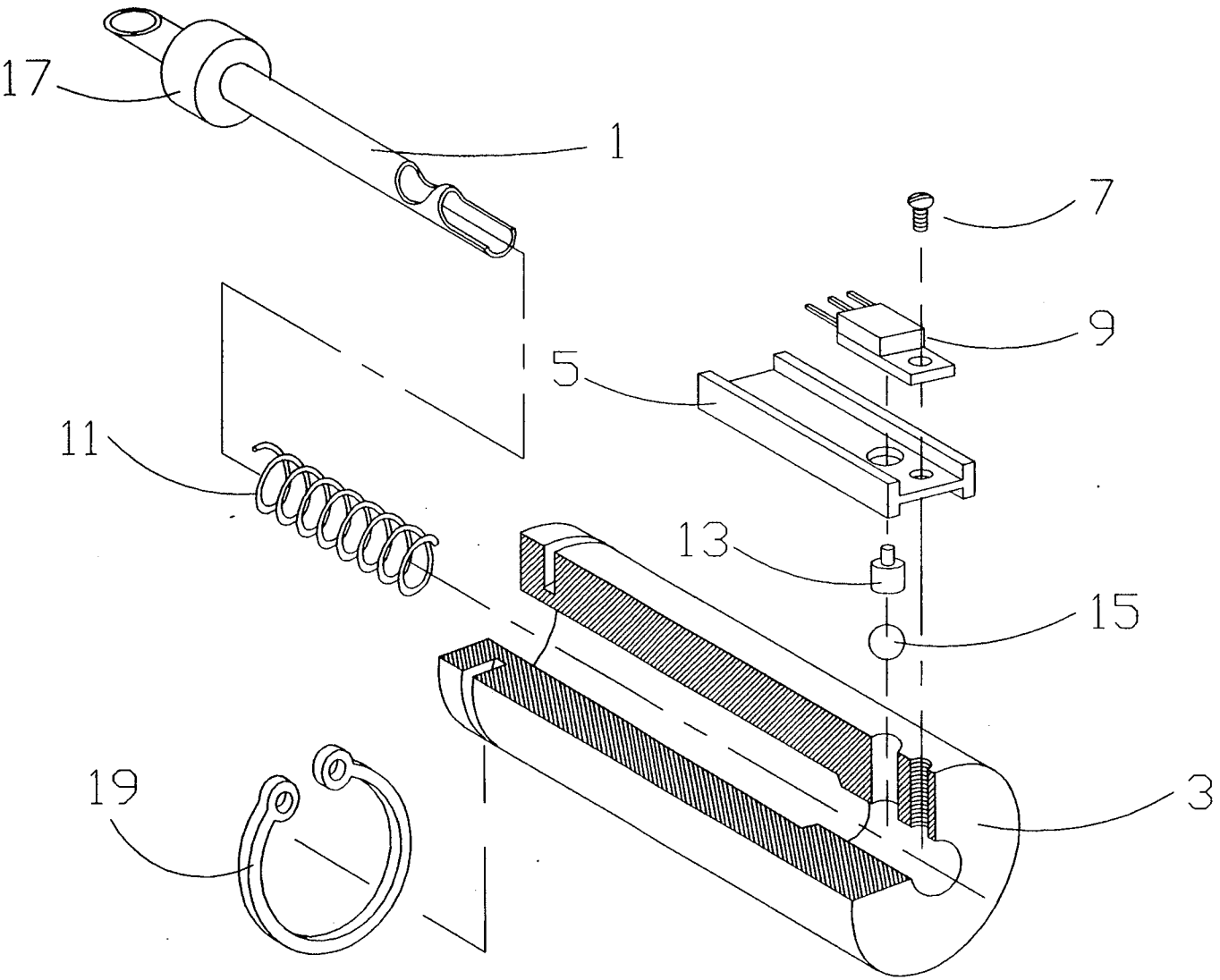
FIG. 4 depicts an exploded view of the valve housing.

In FIG. 1, we note an overview of the self-contained smoke activated fire extinguishing flooding system which is in an enclosure 41. There is a halogenated gas bottle 23 that contains a blended mixture of fire extinguishing gases. As shown in FIG. 3, on top of the halogenated gas bottle 23 is a valve housing 3 which contains: a) valve plunger 1, b) insulator 5, c) power transistor 9, d) fusible link material 13, e) spring 11, f) ball bearing 15, g) collar 17, and h) a snap ring 19 that attaches the valve housing 3 to the halogenated gas bottle 23. The ball bearing 15 is used to hold valve plunger 1 in place during non-activated condition. From the power transistor 9, an electrical current can be conducted through insulated wires 47 from the smoke detector 27 to heat up the fusible link material 13 which releases the ball bearing 15 and allows valve plunger 1 to slide down forcing the bottle valve 21 open which releases the fire extinguishing gases from the halogenated gas bottle.

Figure 2:
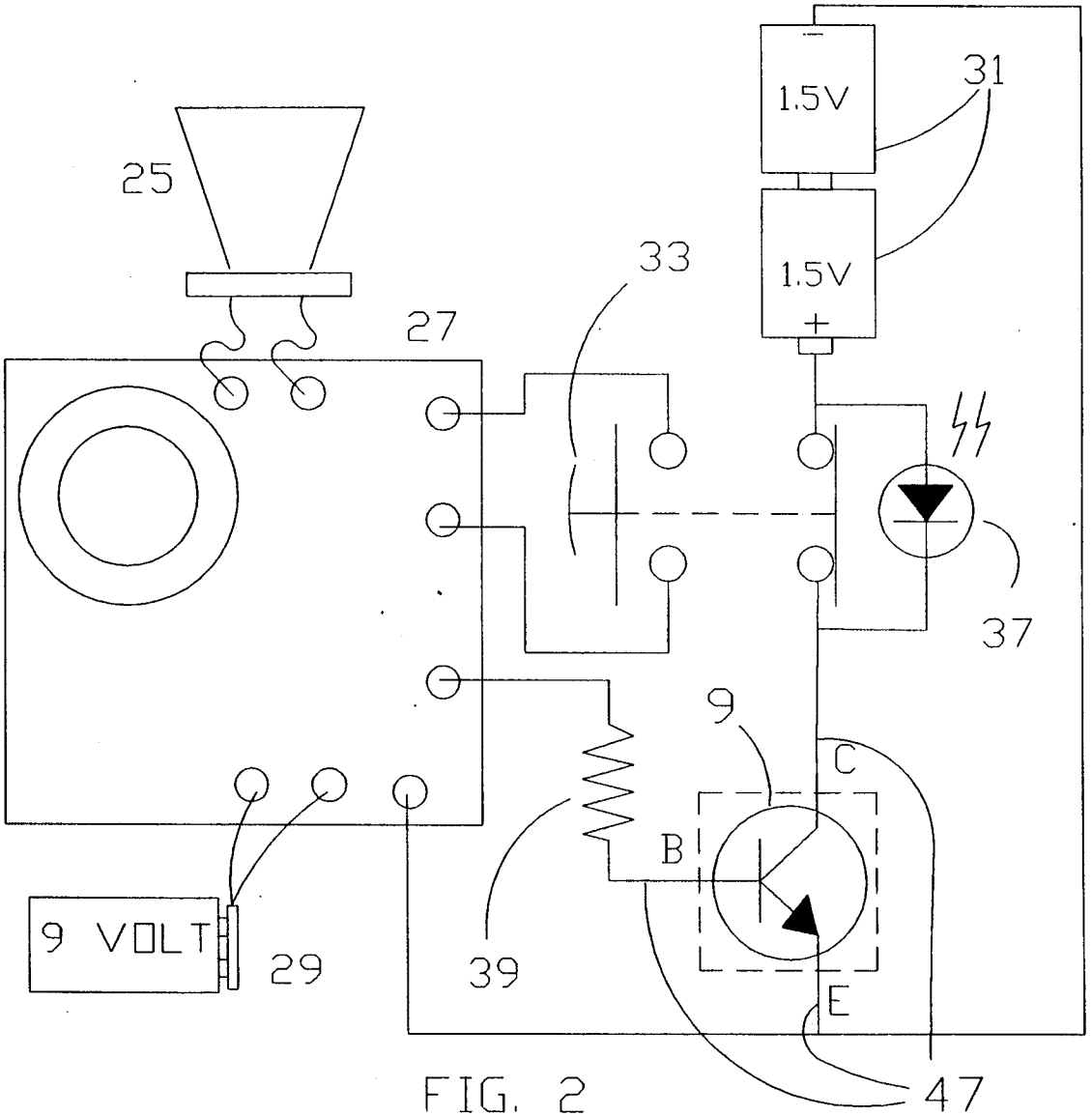
FIG. 2 depicts a schematic diagram of the electrical circuit used to activate the self-contained smoke activated fire extinguishing flooding system.

In FIG. 2, the schematic diagram indicates two power sources, the 9.0 volt battery 29 and the two 1.5 volts "D" cell batteries 31. There is an audio horn 25, smoke detector 27, Power Transistor 9, test switch 33, LED light 37, and 1200 ohms, ½ watt resistor 39.

The self-contained smoke activated fire extinguishing flooding system disclosed herein is especially designed for use in an enclosed area that needs fire protection. A destructive fire, normally, goes through an initial smoldering stage which releases a vapor that has minute carbon particles suspended in it. Air passes through vents 45 in enclosure 41 and is continuously monitored by smoke detector 27 using an ionization method of detection (FIG. 1). When smoke detector 27 detects any carbonaceous vapor it generates an electrical alarm signal on its printed circuit board. Smoke detector 27 is a premanufactured device and it has the capability of generating alarm voltages; when it does not detect any carbonaceous vapor it generates zero volts, and when it detects carbonaceous vapor, the smoke detector 27 generates a positive voltage of 8.3 volts. Smoke detector 27 incorporates an audio horn 25 and it is activated only by detection of carbonaceous vapors or by depression of test switch 33 (FIG. 2). A 9.0 volt battery 29 powers the smoke detector 27. An insulated wire 47 from the smoke detector 27 printed circuit board is connected to 1200 ohms, ½ watt resistor 39. The 1200 ohm, ½ watt resistor 39 is used to reduce the base-emitter load going back to the smoke detector 27 thus reducing any change to smoke detector 27 circuitry. From 1200 ohm, ½ watt resistor 39, an insulated wire 47 is connected to the base of the Power Transistor 9. The Power Transistor 9 emitter is connected by an insulated wire 47 to the ground on the smoke detector 27 and this completes the Power Transistor 9 base-emitter loop. Collector-emitter loop of the Power Transistor 9 is in series with two 1.5 volt "D" cell batteries 31 and test switch 33. The normally open contacts in test switch 33 are connected to the smoke detector 27 printed circuit board and the normally closed contacts of test switch 33 are soldered to LED 37. When test switch 33 is depressed, the normally opened contacts will close and activates smoke detector 27 which generates a positive alarm signal and turns on the base-emitter loop of Power Transistor 9 which in turn activates the collector-emitter loop. Because test switch 33 is depressed, the normally closed contacts are opened and the collector-emitter loop current will now go through LED 37. If the circuit is good, the current from the 1.5 volt "D" cell batteries 31 goes through LED 37 and LED 37 lights up. During normal operations, if smoke detector 27 detects carbonaceous vapor it will turn on Power Transistor 9 base-emitter loop which in turn activates collector-emitter loop and all 1.5 volt batteries 31 current will pass through Power Transistor 9. Power Transistor 9 heats up and in a short period of time melts the fusible link material 13 (FIG. 3) which releases the ball bearing 15 that allows the valve plunger 1 to slide down and release the fire extinguishing gas from the halogenated gas bottle 23 through the gas release port 43 to the desired area (FIG. 1).

From the foregoing, it will be appreciated that the present invention provides a simplified and economical means to utilize an inexpensive flooding system for fire protection of small electronic, electrical or other types of enclosures. The smoke actuated fire extinguishing flooding system provides:

a) a compact flooding system that can be used in a variety of enclosures for fire protection, b) a quick response time for detecting the early stages of combustion as compared to conventional self-contained flooding system which rely on a thermal sensing device for actuation, c) a simply method to check readiness of system without releasing halogenated agents to the environment, d) an inexpensive to maintain system due to design and components used, and e) a fully automated system that is designed for small enclosed areas of highly sensitive electronic or electrical equipments and others.

While my above description contains many specificities, these should not be construed as limitations on the scope of the invention, but rather as an exemplification of one preferred embodiment thereof. Many other variations are possible and it will be apparent to those skilled in the arts. However as an example, rather than use the audio horn to generate a sound, the electrical lead can be tie into a remote control panel or tie into a device that generates a signal that is transmitted to a remote station.

Thus the scope of the invention should be determined by the appended claims and their legal equivalents, rather than by the example given.

Having now described my invention and the manner in which it may be used, I claim:

1. A self-contained fire-extinguishing flooding system which comprises:

smoke detecting means for firstly detecting a presence of smoke and for secondly generating a first electrical signal and a second electrical signal when the presence of smoke is detected;

warning means for generating a warning upon receiving said first electrical signal;

a gas bottle which contains at least one fire extinguishing agent;

a valve housing which comprises a spring-loaded valve plunger supported by at least one ball bearing, a power transistor which receives said second electrical signal, and a fusible link material interposed between said ball bearing and said power transistor, wherein said second electrical signal activates said power transistor, said power transistor, when activated, heats said fusible link material, said fusible link material, when fused, releases said ball bearing, and said ball bearing, when released, activates said valve plunger, and said valve plunger, when activated, releases said fire extinguishing agent in said gas bottle;

a first low-voltage battery power-source means for supplying electrical energy to said smoke detecting means to operate said smoke detecting means;

a second low-voltage battery power-source means for supplying electrical energy to said power transistor to heat said power transistor which heats said fusible link material when said second electrical signal activates said power transistor.

* * * * *